US005433350A

United States Patent [19]

Graubart

[11] Patent Number: 5,433,350

[45] Date of Patent: Jul. 18, 1995

[54] PUMP APPARATUS FOR DISPENSING A SELECTED ONE OF A PLURALITY OF LIQUIDS FROM A CONTAINER

[75] Inventor: Beth T. G. Graubart, Mahwah, N.J.

[73] Assignee: Reckitt & Colman Inc., Wayne, N.J.

[21] Appl. No.: 213,415

[22] Filed: Mar. 15, 1994

[51] Int. Cl.[6] ..... B67D 5/52

[52] U.S. Cl. ..... 222/136; 222/144.5; 222/383.2

[58] Field of Search ..... 222/136, 144.5, 135, 222/129, 383; 239/305

[56] References Cited

U.S. PATENT DOCUMENTS

| | | | |
|---|---|---|---|
| 4,355,739 | 10/1982 | Vierkotter | 222/144.5 |
| 5,009,342 | 4/1991 | Lawrence et al. | 222/136 |
| 5,152,431 | 10/1992 | Gardner et al. | 222/144.5 |
| 5,152,461 | 10/1992 | Proctor | 222/136 |

*Primary Examiner*—Andres Kashnikow
*Assistant Examiner*—Philippe Derakshani
*Attorney, Agent, or Firm*—John R. Moses; Frederick H. Rabin

[57] ABSTRACT

A pump apparatus for dispensing a selected one of a plurality of liquids includes a pump housing containing a pump which is fixed to a container having a plurality of compartments, each accessed by a separate dip tube. The dip tubes each communicate with bores through a base disposed at the top of the container. A thumb wheel with a single bore is rotated about a central access to align the single bore with the selected one of the dip tubes and the single bore is connected to the pump via a crank-shaped connecting tube. Preferably, the thumb wheel is accessed through a window in the pump housing and has indicia thereon to indicate which of the liquids has been selected for dispensing by the pump.

8 Claims, 3 Drawing Sheets

FIG. 7
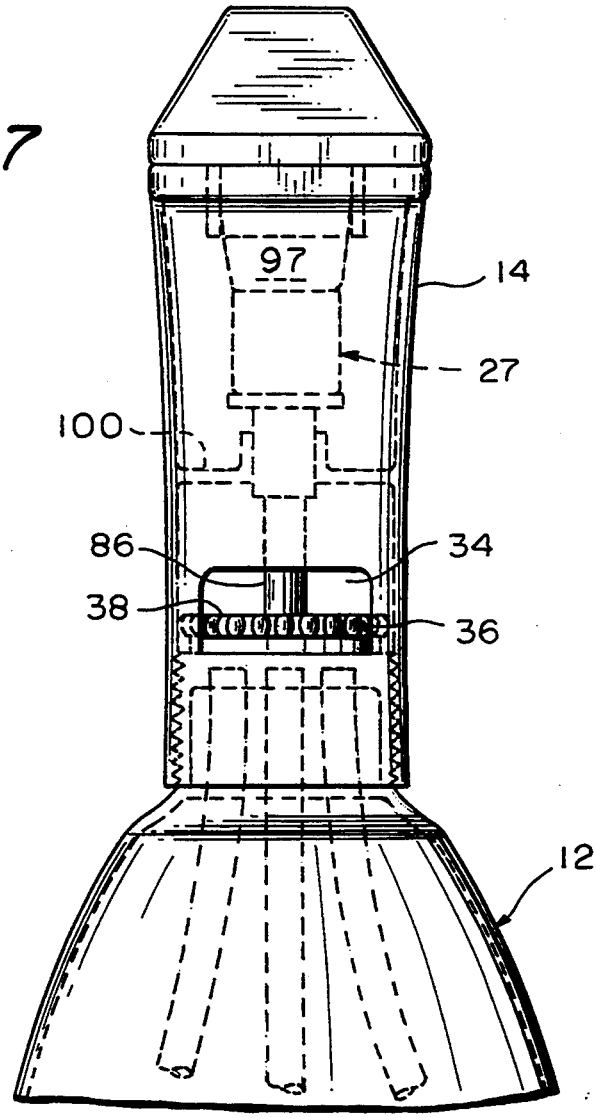
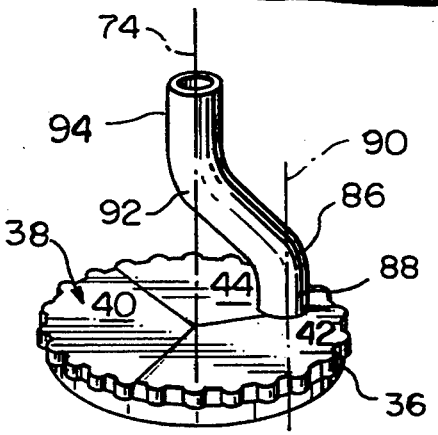
FIG. 8
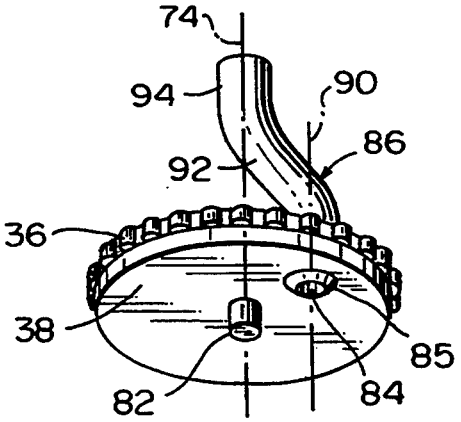
FIG. 9

PUMP APPARATUS FOR DISPENSING A SELECTED ONE OF A PLURALITY OF LIQUIDS FROM A CONTAINER

1. Field of the Invention

The instant invention relates to a pump apparatus for dispensing one of a plurality of separate liquids, and more particularly, the instant invention relates to a pump apparatus for dispensing a selected one of the liquids from a single container.

2. Background of the Invention

There are a number of different cleaning products for household and commercial use, which products are used in conjunction with one another. For example, in cleaning a bathroom, one may use a toilet bowl cleaner, a glass cleaner, a disinfectant and perhaps a mold or mildew cleaner. Each of these products is packaged in its own bottle and one ends up carrying a number of separate bottles from room to room. Moreover, a number of bottles must be stored as opposed to a single bottle or container. Anything which makes household chores easier and quicker is usually welcomed by consumers. A solution to this problem is suggested in the patent literature, wherein a plurality of containers are connected together or a compartmented container is used instead of separate containers. U.S. Pat. Nos. 3,211,343; 3,269,605; 3,272,387; 3,366,297; and 3,596,802 each utilize valves disposed between a pressurized liquid and a nozzle wherein, when the valves are opened, the pressurized liquids escape. In order to pressure liquids in these containers, chlorofluorocarbons (CFCs) are utilized. Since chlorofluorocarbons are considered an environmental hazard, they are being phased out. U.S. Pat. Nos. 3,876,112 and 4,826,048 each teach a separate dispensing means for each liquid instead of utilizing a single pump which is a somewhat inconvenient arrangement. U.S. Pat. No. 4,355,739 discloses utilizing a single pump, but the single pump dispenses either a single liquid or a mixed liquid instead of selectively dispensing one of a number of single liquids.

The aforementioned difficulties of the aforementioned dispensers has resulted in dispensers such as that of U.S. Pat. No. 5,009,342 which is configured for dispensing two liquids which may be mixed during the dispensing operation and U.S. Pat. No. 5,152,431 in which more than two liquids may be dispensed without mixing. However, in the liquid dispenser of U.S. Pat. No. 5,152,431, it is necessary to turn the pump assembly with respect to the bottle containing the plurality of liquids. This can be an inconvenient procedure.

In view of the aforementioned considerations, there is a need for a multi-liquid dispensing system for dispensing liquids one at a time, unmixed, from a single container or perhaps multiple containers nested in proximity to one another.

SUMMARY OF THE INVENTION

It is an object of the instant invention to provide a new and improved arrangement for selectively dispensing one of a plurality of liquids from adjacent compartments through a single pump, wherein selection of the liquid to be dispensed is convenient and can be accomplished with one hand.

Upon further study of the specification and appended claims, further objects and advantages of this invention will become apparent to those skilled in the art.

In view of this object and other objects, the instant invention contemplates a pump assembly for dispensing liquid from a selected one of several juxtaposed compartments wherein the pump assembly comprises a pump housing including therein a pump mechanism and having thereon a nozzle for dispensing liquid therethrough. The pump housing includes a tube therein having one end in communication with the pump and the other end in communication with a bore through a thumb wheel which is accessed from outside of the pump housing. Upon rotation of the thumb wheel, the tube is aligned with one of a plurality of dip tubes that are fixed with respect to the thumb wheel and are each immersed in a separate compartment.

In accordance with the preferred embodiment of the invention, the compartments are formed in a single container having a threaded neck onto which the pump is threadably mounted.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein:

FIG. 7 is a back view of the bottle and pump of FIGS. 1 and 3 with portions in phantom;

FIG. 8 is a top perspective view of a thumb wheel and integral tube used within the pump; and FIG. 9 is a bottom perspective view of the thumb wheel and integral tube of FIG. 8.

DETAILED DESCRIPTION

Figure 1:
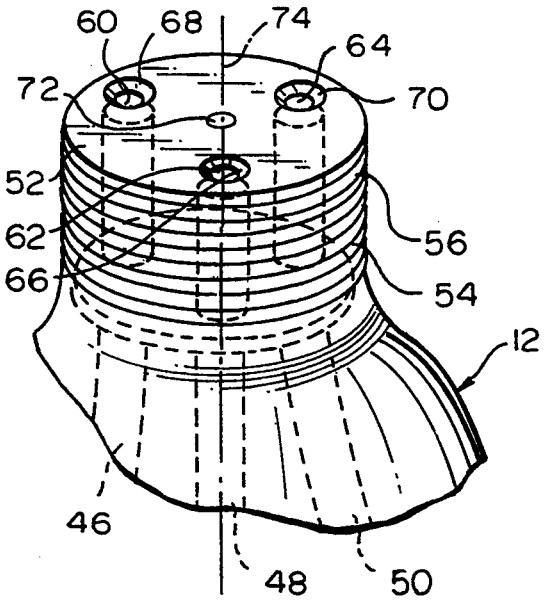
FIG. 1 is a perspective view of the top of a multi-compartmented bottle having a pump, configured in accordance with the principles of the instant invention mounted thereon.
Figure 2:
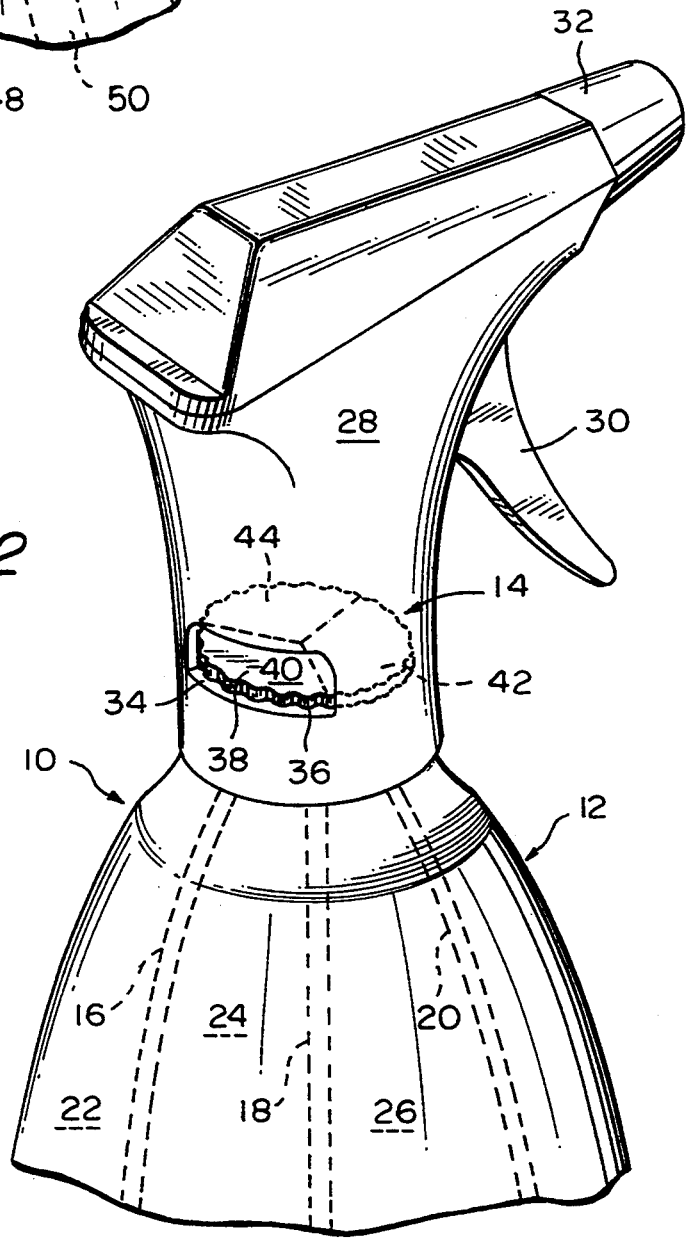
FIG. 2 is a top perspective view of a portion of the bottle of FIG. 1 prior to mounting the pump.
Figure 4:
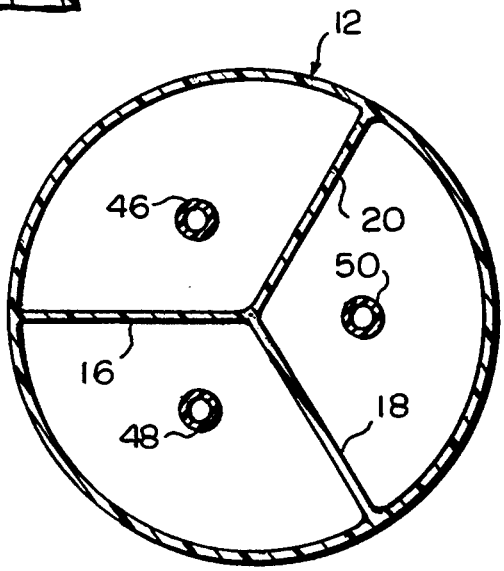
FIG. 4 is a section through the bottle taken along lines 4—4 of FIG. 3.
Figure 6:
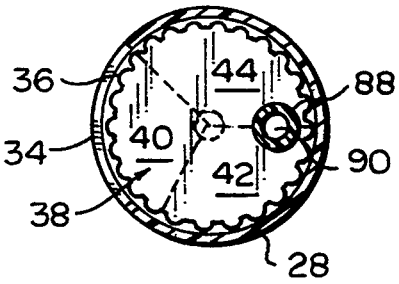
FIG. 6 is a section taken along lines 6—6 of FIG. 3 showing a thumb wheel mounted within the pump.

Referring now primarily to FIGS. 1 and 2, there is shown a pump and container combination 10 comprised of a bottle 12 and a pump 14. The bottle 12 is divided by partitions 16, 18 and 20 into a plurality of compartments 22, 24 and 26 (see FIG. 4). While three partitions 16–20 are shown and three compartments 22–26 are shown, it is to be remembered that the number of partitions and the number of compartments will vary in accordance with the number of liquids to be dispensed.

In accordance with the principles of the instant invention, the pump 14 has a pump mechanism 27 (see FIG. 3) within a housing 28 which is operated by a trigger 30 to dispense liquid from the bottle 10 through a nozzle 32. Positioned on the opposite side of the housing 28 from the nozzle 32 and trigger 30 is a window 34 through which a knurled periphery 36 of a thumb wheel 38 projects. By providing a thumb wheel 38 opposite the trigger 30, it is possible to dial the liquid being dispensed through the nozzle while using only one hand.

The thumb wheel 38 is divided into segments 40, 42 and 44 which register with the slot 34 to indicate which of the liquids in compartments 22, 24 and 26 will be dispensed upon squeezing the trigger 30. This allows the person cleaning to scrub with one hand while dispensing the selected liquid with the other, the liquid being dispensed being identified by the segment 40, 42 or 44 in registration with the window 34.

It is seen that the compartments 22, 24 and 26 each have dip tubes 46, 48 and 50, respectively, extending therein from a top wall 52 which closes the neck 54 of the bottle 12 and forms a base for mounting the thumb wheel 38. The neck 54 has a thread 56 thereon for threadably mounting the housing 28 to the pump 14. The top wall or base 52 includes bores 60, 62 and 64 therein which align with the dip tubes 46, 48 and 50. The bores 60–64 have concave frusto-conical surfaces 66, 68 and 70 for interfacing with the thumb wheel 38 as will be explained hereinafter. A circular bore 72 is positioned as the access 74 of the circular flange 52.

Figure 3:
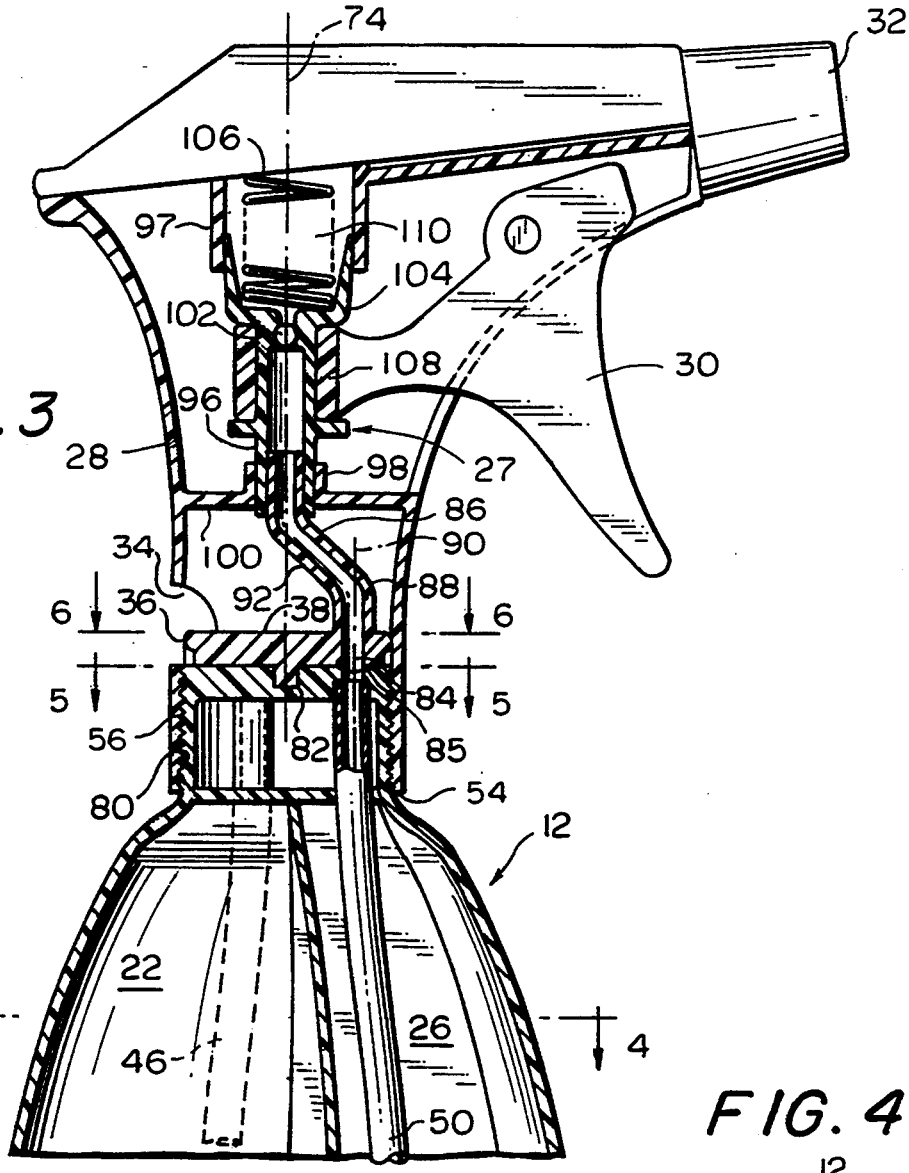
FIG. 3 is a side elevation of the pump and bottle shown in FIG. 1.

Referring now to FIG. 3, where the structure of the pump 14 within the pump housing 28 is shown in detail, it is seen that the pump housing 28 has internal threads 80 which mesh with external threads 56 on the neck 54 of the bottle 12 in order to secure the pump housing and thus the pump to the bottle 12. The thumb wheel 38 has a mounting post 82 (also see FIG. 9) thereon which is received within the circular bore 72 of the circular top wall 52 that closes the neck 54 of the bottle 12. The thumb wheel 38 has a bore 84 therethrough which is preferably unitary with a resilient crank-shaped tube 86. Since the crank-shaped tube 86 is resilient, it urges the thumb wheel 38 against the base 52. The bore 84 has a projecting detent portion 85 which aligns selectively with a selected one of the ports 60, 62 and 64 upon rotating the thumb wheel 38 so as to align with a selected one of the dip tubes 46, 48 and 50. Upon squeezing the trigger 30, the pump 27 withdraws liquid from one of the compartments 22, 24 or 26.

Figure 5:
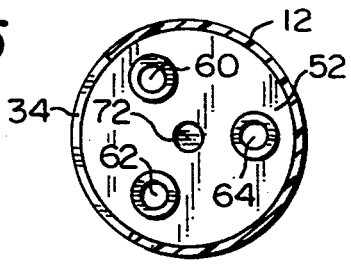
FIG. 5 is a section taken along lines 5—5 of FIG. 3 showing the top of the bottle.

As is seen in FIGS. 5, 8 and 9, the tube 86 has a first end 88 which is aligned with an axis 90, an oblique intermediate portion 92 and a second end portion 94, which second end portion is aligned with the axis 74 about which the thumb wheel 38 rotates. As is seen in FIGS. 3, 7 and 8, the second end portion 94 of the tube 86 is received within a bushing 96 forming an inlet tube for a piston 97 aligned with the axis 74 of the pump 14. The piston 97 is in turn supported by a collar 98 of an internal flange 100 which is unitary with the housing 28. The piston 97 has a check valve 102 therein and a cup portion 104 which receives a coil spring 106. The trigger 30 has a collar 108 which surrounds the piston tube 96 and lifts the cup portion 104 of the piston 97 against the bias of the coil spring 106 to load a chamber 108 while dispensing fluid through the nozzle 32. The mechanism by which fluid is dispensed through the nozzle 32 is conventional and known extensively in the prior art.

While a particular piston and trigger arrangement is illustrated for purposes of clarification and disclosure, it is only necessary that the elements of the pump 27 communicate with the tube 86 so that the liquid which has been selected by the position of thumb wheel 38 can be transmitted to the pump.

With the aforediscussed arrangement, selection of the appropriate fluid is accomplished by simply rotating the thumb wheel 38 until the indicia 40, 42 or 44 of the selected fluid in the container 12 appears in the window 34. This can be accomplished with one hand leaving the other hand free to utilize a cleaning implement.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An arrangement for dispensing liquid from a selected one of a plurality of juxtaposed compartments, the arrangement comprising:

a plurality of dip tubes, one of which extends into each compartment;

a base having bores therethrough, each of which is in communication with one of the dip tubes;

a thumb wheel rotatably mounted on the base for rotation about a central axis, the thumb wheel having a single bore therethrough which bore is selectively aligned with one of the bores in the base;

a connector tube extending from the bore in the thumb wheel and having an end in alignment with the central axis of the pump;

a housing having a window with the thumb wheel being aligned with and accessed by the window; and a pump mounted in the housing, the pump having an outlet tube in the form of a bushing for receiving the upper end of the connected tube and a trigger for operating the pump, wherein, when the thumb wheel is rotated about the central axis, the tube connects a selected one of the dip tubes with the pump.

2. The arrangement of claim 1, wherein the thumb wheel has indicia thereon which is alignable with the window to indicate which of the liquids is being dispensed.

3. The arrangement of claim 1, wherein the bores in the base are each positioned the same distance from this central access of the pump as the single bore through the thumb wheel whereby rotation of the thumb wheel brings the single bore into alignment with one of the bores through the base.

4. The arrangement of claim 3, wherein the thumb wheel is spring biased with respect to the central access toward the base and wherein detent means for retaining the thumb wheel in a selected position is provided.

5. The arrangement of claim 4, wherein the detent means is disposed between the thumb wheel and base.

6. The arrangement of claim 5, wherein the detent means comprises a projection on the thumb wheel aligned with the bore therethrough which is received in a selected one of the bores through the base.

7. The arrangement of claim 6, wherein the tube connecting the bore through the thumb wheel to the pump is resilient and provides axial biasing means for urging the thumb wheel against the base.

8. The arrangement of claim 1, wherein the plurality of juxtaposed compartments occur in a single container having a neck and wherein the neck has an external thread which mates with an internal thread on the pump housing.

* * * * *